United States Patent [19]

Pirwitz et al.

[11] Patent Number: 4,689,471

[45] Date of Patent: Aug. 25, 1987

[54] HEAT AND PRESSURE FUSER FOR FIXING TONER IMAGES TO COPY SUBSTRATES

[75] Inventors: Robert G. Pirwitz; John L. Webb, both of Fairport, N.Y.

[73] Assignee: Xerox Corporation, Stamford, Conn.

[21] Appl. No.: 820,427

[22] Filed: Jan. 18, 1096

[51] Int. Cl.[4] ..... G03G 15/20

[52] U.S. Cl. ..... 219/216; 355/3 FU

[58] Field of Search ..... 355/3 FU, 3 R; 219/216, 219/469

[56] References Cited

U.S. PATENT DOCUMENTS

| | | | |
|---|---|---|---|
| 3,632,984 | 1/1972 | Brownscombe | 219/469 |
| 4,059,394 | 11/1977 | Ariyama et al. | 355/3 FU |
| 4,112,280 | 9/1978 | Salsich et al. | 219/216 |
| 4,253,008 | 2/1981 | Dolan | 355/3 FU |
| 4,315,136 | 2/1982 | Block et al. | 355/3 FU |
| 4,335,951 | 6/1982 | Scribner | 355/3 FU |
| 4,566,783 | 1/1986 | Schwierz et al. | 355/3 FU |

*Primary Examiner*—R. L. Moses

[57] ABSTRACT

Heat and pressure fuser for fixing toner images to copy substrates wherein a heated roll or roller contacts the toner images on the copy substrates and a non-rotating, elongated pressure member cooperates with the roll or roller to form an elongated nip. The heated roll is fabricated such that it constitutes a low mass member. The fuser of the present invention is relatively low in cost, simple in construction, occupies less space in the machine than prior art devices and has a fuser roll which has a relatively low mass.

A pressure member in the form of a sling or web is urged into pressure contact with the surface of the fuser roll. One of the ends of the web or sling is captivated in a machine structure while the other end is biased into pressure engagement with the fuser roll. A portion of the sling closer to the captivated end thereof is also biased into engagement with the fuser roll. The web is urged into engagement with the fuser roll by a blade structure such that a relatively low (6 pounds over the 36 inches of width) force is developed therebetween. The mechanism by which the pressure between the fuser roll and the sling effected is constructed to minimize stalling of the copy substrates upon entry into the fuser nip and to improve the efficiency of substrate movement through the nip.

The use of the sling or web and the manner in which it is installed relative to the fuser roll results in a lower overall height making the fuser suitable for use in smaller machines as well as providing at fuser which is simpler in construction and design and which is lower in cost than prior art devices.

The sling or web is fabricated from a material and in a manner such that the friction between the sling and copy substrates moved between the sling and the fuser roll is less than the friction developed between the copy substrate and the fuser roll.

18 Claims, 4 Drawing Figures

HEAT AND PRESSURE FUSER FOR FIXING TONER IMAGES TO COPY SUBSTRATES

BACKGROUND OF THE INVENTION

This invention relates generally to xerographic copying apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by the use of heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

The commonly utilized approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the other image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset". Splitting occurs when the cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene or silicone rubber, the former being known by the tradename Teflon, to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid Teflon outer surface or covering of the aforementioned arrangement.

While heat and pressure fusers of the prior art, in particular the type discussed above, are desirable because of their thermal efficiency they are undesirable because of their mechanical complexity, cost, long warm-up times and paper wrinkling.

It is known that reducing the mass of a roll fuser member such as the heated fuser roll substantially reduces the required warm-up time for roll fusers. However, low mass fuser roll members are not capable of withstanding the relatively high pressures exerted by conventional pressure or backup members in order to form a suitable nip. This is particularly true in the case of oversized (i.e. approximately 3 feet (91.44 Centimeters) in length) fusers, typical roll fuser lengths being in the order of 12 to 18 inches (30.48 to 45.72 Centimeters). This is because of the relatively large forces needed for effecting the pressure engagement required to form the nip therebetween. Not only are conventional pressure applying members such as a pressure or backup roll incompatible with low mass fuser rolls they are quite costly and complex in construction. Also, they occupy a relative large area in the machine.

As will be appreciated in view of the foregoing, a heat and pressure fuser that has a relatively low mass; that is simple in construction; that is low in cost and that occupies a minimum of space within the machine is quite desirable.

DESCRIPTION OF THE PRIOR ART

U.S. Pat. No. 3,249,738 assigned to Agfa Aktiengesellschaft Leverkusen and entitled APPARATUS FOR PRODUCING PHOTOGRAPHIC IMAGES AND PRINTING PLATES discloses a heated drum and an endless band which is pressed against the drum over approximately one half the drum's circumference. The band is entrained about a plurality of rollers so that the band moves in contact with the drum in a predetermined direction.

U.S. Pat. No. 3,637,976 assigned to Ricoh Co., Ltd. entitled FIXING DEVICE OF TONER IMAGES discloses a heat and pressure fuser comprising an internally heated fuser roll and a pressure applying member, the latter of which comprises an endless belt entrained about a pair of transport rollers.

U.S. Pat. No. 3,667,742 assigned to Xerox Corporation entitled FIXING ARRANGEMENT discloses apparatus for fusing toner images onto a support in which a pair of elastically deformable shell members of a generally cylindrical shape are each supported in a deformed generally elliptical configuration about a pair of parallel spaced roller members. A source of heat is provided for heating each of the shell members.

U.S. Pat. No. 3,718,116 assigned to Xerox Corporation and entitled OIL DISPENSING APPARATUS discloses a roll fuser that utilizes a wick structure including a member fabricated from the copolymer of meta-phenylenediamine and isophthaloyl chloride.

U.S. patent application Ser. No. 666,596 filed in the name of Scott D. Reynolds et al and assigned to Xerox Corportion and entitled LOW MASS HEAT AND PRESSURE FUSER discloses a low mass, heated belt cooperating with a pressure roll to form a nip through which copy substrates pass with the toner images contacting the belt.

BRIEF DESCRIPTION OF THE INVENTION

In accordance with the intents and purposes of the present invention we have provided a heat and pressure fuser which is relatively low in cost, simple in construction, has a fuser roll which has a relatively low mass and occupies less space in the machine than prior art devices.

The fuser of our invention comprises a low mass fuser roll or roller and a pressure member hereinafter disclosed in detail as sling or web that is urged into pressure contact with the surface of the fuser roll. One of the ends of the web or sling is captivated in a machine structure while the other end is biased into pressure engagement with the fuser roll. A portion of the sling closer to the captivated end thereof is also biased into engagement with the fuser roll. The web is urged into engagement with the fuser roll by means of a blade structure such that a relatively low force (i.e. 6 pounds (2.72 Kilograms) is developed therebetween over the 40 inches (101.6 Centimeters) of width. The blade structure improves the efficiency of substrate movement through the nip. The blade structure is provided with a slight curvature where it contacts the web and the fuser roll which minimizes stalling of the copy substrates upon entry into the fuser nip.

The use of the sling or web and the manner in which it is installed relative to the fuser roll results in a lower overall height making the fuser suitable for use in smaller machines as well as providing a fuser which is simpler in construction and design and which is lower in cost than prior art devices.

The sling or web is fabricated from a material and in a manner such that the friction between the sling and copy substrates moved between the sling and the fuser roll is less than the friction developed between the copy substrate and the fuser roll.

DETAILED DESCRIPTION OF THE INVENTION

Figure 1:
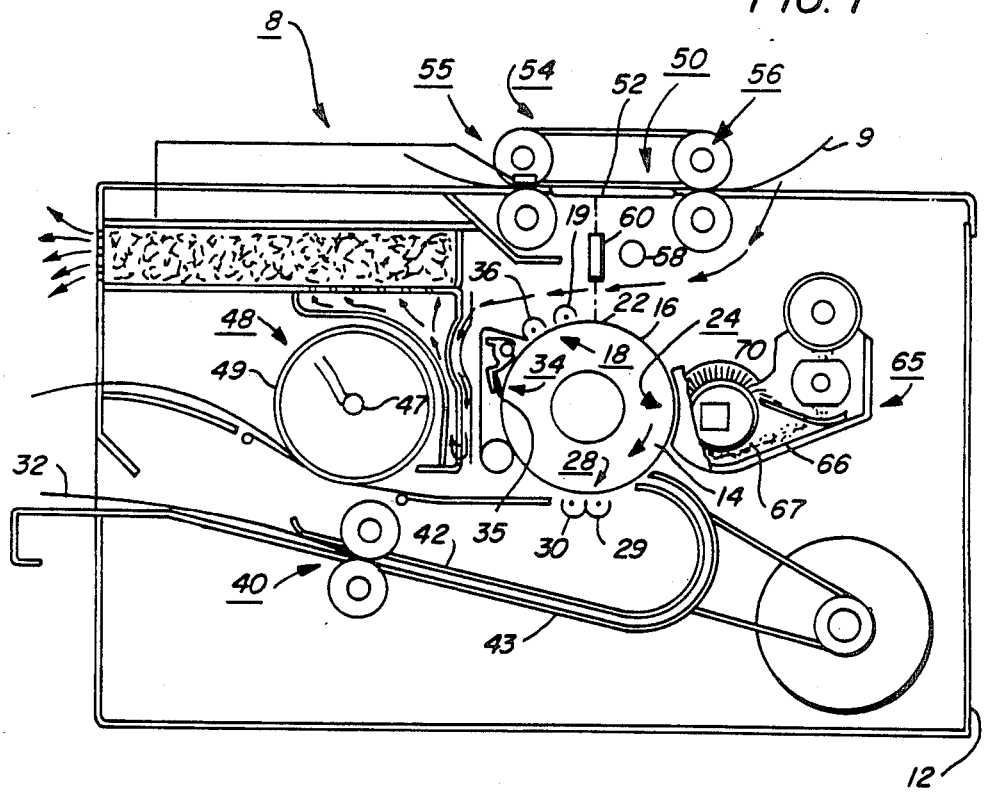
FIG. 1 is a side view in section of a reproduction machine having the improved heat and pressure fuser of the present invention.

Referring to FIG. 1 of the drawings, there is shown a xerographic type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form of a rotatable photoreceptor 14. In the exemplary arrangement shown, photoreceptor 14 comprises a drum having a photoconductive surface 16. Other photoreceptor types such as belt, web, etc. may instead by employed.

Operatively disposed about the periphery of photoreceptor 14 are a charging station 18 with charge corotron 19 for placing a uniform charge on the photoconductive surface 16 of photoreceptor 14; exposure station 22 where the previously charged photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 and detack corotron 30 for sequentially transferring the developed image to a suitable copy substrate material such as a copy sheet 32 brought forward in timed relation with the developed image on photoconductive surface 16 and lessening the forces of attraction between the copy substrate and the charge retentive member; and cleaning station 34 with cleaning blade 35 and discharge corotron 36 for removing leftover developer from photoconductive surface 16 and neutralizing residual charges thereon.

A copy sheet 32 is brought forward to transfer station 28 by feed roll pair 40. Sheet guides 42, 43 serve to guide the sheet through an approximately 180 degree turn prior to the copy substrate reaching the transfer station 28. Following transfer, the sheet 28 is carried forward to a fusing station 48 where the toner image is contacted by fusing roll 49 forming one member of a heat and pressure fuser. Fusing roll 49 is heated by a suitable heat such as quartz lamp 47 disposed within the interior of roll 49. After fusing, the copy sheet 28 is discharged from the machine.

A transparent platen 50 supports the document 9 as the document is moved past a scan area 52 by a constant velocity type transport 54. As will be understood, scan area 52 is in effect a scan line extending across the width of platen 50 at a desired point along platen 50 where the document is scanned line by line as the document is moved along platen 50 by transport 54. Transport 54 has input and output document feed roll pairs 55,56 respectively on each side of scan area 52 for moving document 9 across platen 50 at a predetermined speed. Exposure lamp 58 is provided to illuminate a strip-like area of platen 50 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed in a predetermined operative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled thermally conductive tube having a thin (i.e. approximately 0.005 inch (0.01 Centimeters)) coating of silicone rubber on the exterior surface thereof which contacts the toner images on the copy substrate to thereby affix them to the substrate. A release agent management system, not shown, applies a thin layer of silicone oil to the surface of the fuser roll for the prevention of toner offset thereto as well as reducing the torque required to effect rotation of the fuser roll. In one operative embodiment of the fuser roll its diameter was 3.3 inches and had a length of 40 inches. This embodiment is typically used to fuse images on copy substrates that are 3 feet (0.91 Meters) wide by 4 feet (1.22 Meters) in length.

The fuser apparatus 48 in the preferred embodiment also comprises a non-rotating, elongated pressure member 72 herein illustrated as a web or sling. The sling preferably comprises a woven fabric made from a heat resistant material that comprises the copolymer of metaphenylenediamine and isophthaloyl chloride. The sling retains its properties after long-term exposure to temperatures up to 220 degrees centigrade.

Figure 2:
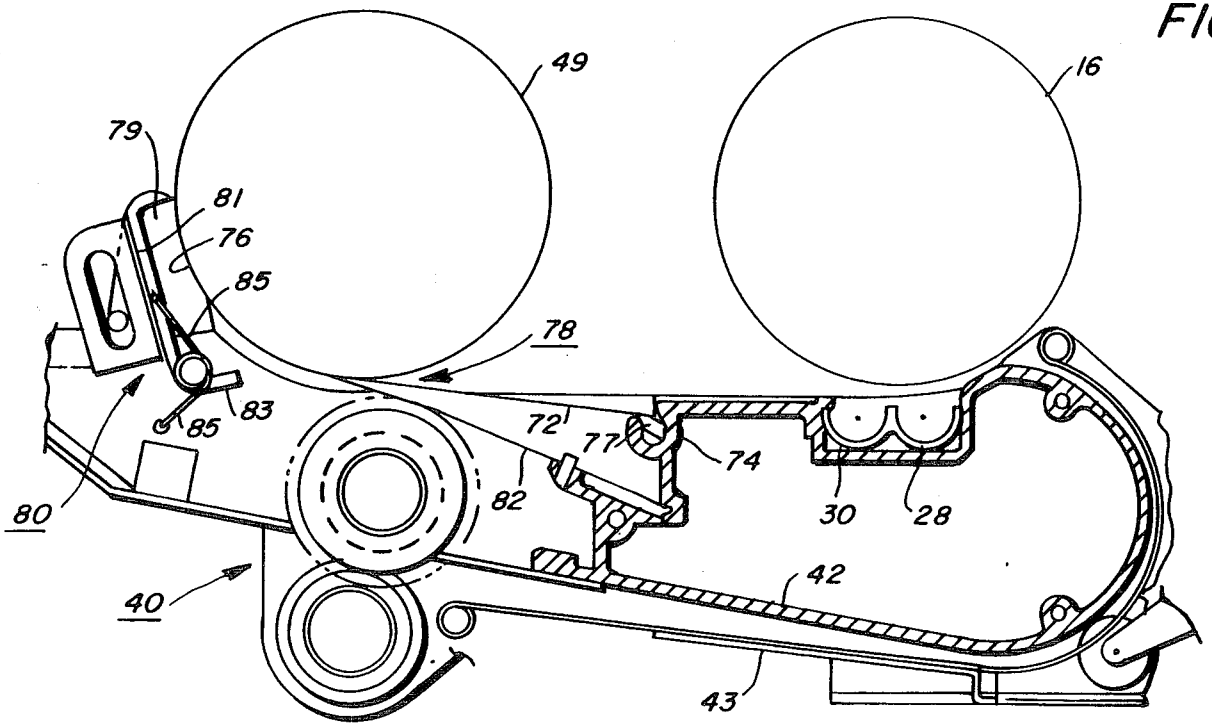
FIG. 2 is a fragmentary schematic view of a heat and pressure fuser of the present invention.

As viewed in FIG. 2, one end of the sling 72 is anchored in a frame structure 72 by means of a rectangular rod 75. The opposite end of the sling is biased into engagement with the fuser roll as indicated by reference character 76 such that the fuser roll and the sling cooperate to form an elongated nip 78 therebetween. The rod is insertable into a slot 77 when it is rotated 90 degrees from the position shown. In the position shown, the rod cannot be removed from the slot.

A pressure applying mechanism 80 comprising a plate 81 and a pad 79 creates a force between the roll and the sling so as to produce a frictional force therebetween that keeps the sling in tension so it can provide suitable pressure to the surface of the fuser roll. The pad which is relatively thick is preferably fabricated from a needled felt material. The plate 81 is pivotally mounted by a pin structure 83 and a spring structure 85 serves to bias the plate and therefore the pad 79 into its operative position.

A blade member 82 has one end anchored in the frame structure 74 while its other end contacts the sling as indicated at 84 serves to apply a load against the sling and thereby cooperate with the spring mechanism 80 to effect the required pressure in the nip for satisfactory operation. The area of contact between the web and the fuser roll forms the entrance to the nip area. The blade is preferably fabricated from thermally conductive material and is mounted such that in its free state it is flat and in its operative state the edge of the blade is deflected by the fuser roll to thereby cause it to function as a leaf spring, applying the aforementioned load against the web or sling. Edge contact of the blade produces the highest possible pressure for a given force or load. The purpose of the blade is to control paper cockle caused by the rapid drying of high moisture content paper.

Figure 3:
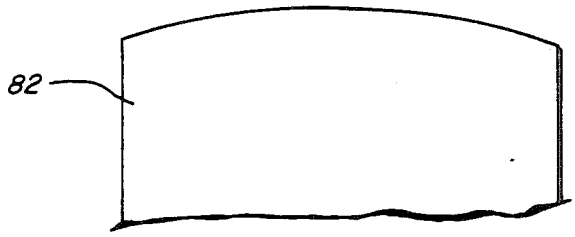
FIG. 3 is a top fragmentary view of a biasing blade structure of the fuser of FIG. 2.

As viewed from the top in FIG. 3, the blade edge has a slight curve to it. The slight curve prevents paper from stalling at the nip entrance. Stalling has been observed when using a blade with a straight edge when the lead edge of the paper arrives at and attempts to penetrate the nip at the same time. The blade is relatively thin (i.e. approximately 020 inch (0.102 centimeters) so that it can conform to minor irregularities in the roll surface. The blade is designed to have a low spring rate to preclude appreciable change in spring force due to mechanical tolerance stack-up variations.

In order to optimize paper handling a weave pattern is chosen so that the frictional force developed between the sling and the substrate is considerably lower than the frictional developed between the substrate and the roll. The foregoing optimizes the driving of the copy substrate through the nip by the fuser roll and minimizes lead edge stalling at the nip entrance.

As an alternative to using the sling, an elongated brush could be utilized. The brush has an arcuate shape in cross section so that its bristles follow the curvature of the fuser roll. Like the sling, the brush which is stationarily mounted relative to the fuser roll cooperates with the fuser roll to form a low pressure nip through which copy substrates can readily be transported by means of the fuser roll.

Figure 4:
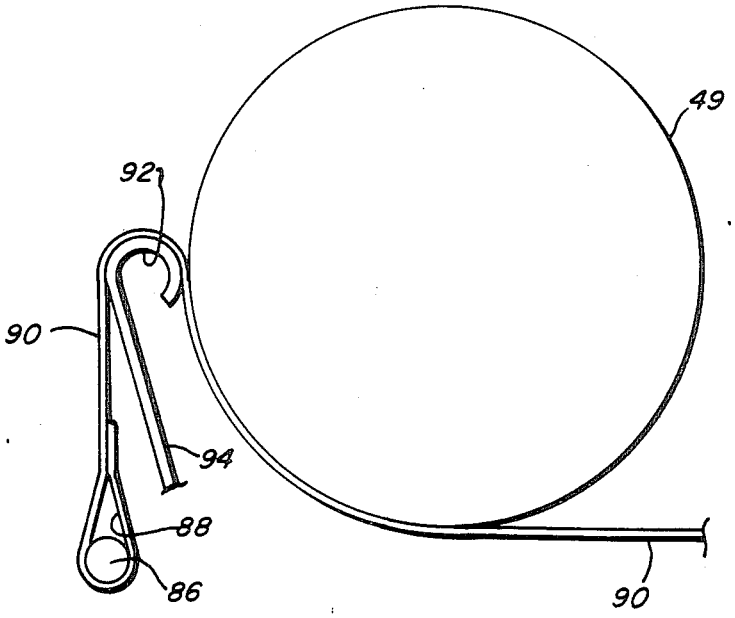
FIG. 4 is a fragmentary view of a modified embodiment of the invention.

As illustrated in FIG. 4, an alternative pressure applying structure designated by the reference character 84 comprises a weighted rod 86 disposed in a loop 88 formed in a web or sling 90. One end of the web or sling 90 is anchored in the machine frame in the same manner as the web 72 while the opposite end is formed into the loop 88. A portion of the web or sling 90 intermediate the two ends thereof rides over a curved portion 92 of a sling frame or support member 94. A biasing force is applied to the frame or support member 94 in a manner similar to that of the embodiment illustrated in FIG. 2 to thereby urge the web or sling 90 into engagement with the fuser roll 49. The force so applied is just sufficient to keep the sling or web against the roll.

What is claimed is:

1. Heat and pressure fuser apparatus for fixing toner images to copy substrates, said apparatus comprising:

a fuser roll;

means for elevating the temperature of said fuser roll;

a pressure applying member in the form of a thin web having an elongated surface contacting said fuser roll to form a nip therebetween through which copy substrates pass with the toner images carried thereby contacting said fuser roll, one end of said thin web being anchored in a frame member and an area of said web adjacent the other end thereof being frictionally biased into engagement with said fuser roll; and a bias member supported such that one edge of its free end contacts said thin web to thereby bias an area of said thin web into contact with said fuser roll to form a nip entrance for receiving the lead edge of copy substrates.

2. Apparatus according to claim 1 wherein said edge of said bias member is constructed such that stalling of the copy substrates at the entrance of the nip is minimized.

3. Apparatus according to claim 2 wherein said bias member comprises a blade and said edge is slightly curved.

4. Apparatus according to claim 2 wherein said fuser roll comprises a low mass structure.

5. Apparatus according to claim 4 wherein said web is fabricated from a heat resistant woven fabric.

6. Apparatus according to claim 5 wherein said heat resistant woven fabric comprises the copolymer of meta-phenylenediamine and isophthaloyl chloride.

7. Apparatus according to claim 6 wherein said fuser roll comprises a low mass structure.

8. Printing apparatus for forming toner images on copy substrates, said apparatus comprising: a fuser roll;

means for elevating the temperature of said fuser roll;

a pressure applying member in the form of a thin web having an elongated surface contacting said fuser roll to form a nip therebetween through which copy substrates pass with the toner images carried thereby contacting said fuser roll, one end of said thin web being anchored in a frame member and an area of said web adjacent the other end thereof being frictionally biased into engagement with said fuser roll; and a bias member supported such that one edge of its free end contacts said thin web to thereby bias an area of said thin web into contact with said fuser roll to form a nip entrance for receiving the lead edge of copy substrates.

9. Apparatus according to claim 8 wherein said bias member comprises a blade and said edge is slightly curved.

10. Apparatus according to claim 8 wherein said edge of said bias member is constructed such that stalling of the copy substrates at the entrance of the nip is minimized.

11. Apparatus according to claim 10 wherein said bias member comprises a blade and said edge is slightly curved.

12. Apparatus according to claim 10 wherein said web is fabricated from a heat resistant woven fabric.

13. Apparatus according to claim 12 wherein said heat resistant woven fabric comprises the copolymer of meta-phenylenediamine and isophthaloyl chloride.

14. Apparatus according to claim 13 wherein said edge of said bias member is constructed such that stalling of the copy substrates at the entrance to said nip is minimized.

15. Apparatus according to claim 14 wherein said fuser roll comprises a low mass structure.

16. Heat and pressure fuser apparatus for fixing toner images to copy substrates, said apparatus comprising:

a fuser roll;

means for elevating the temperature of said fuser roll;

a pressure applying member in the form of a thin web having an elongated surface contacting said fuser roll to form a nip therebetween through which copy substrates pass with the toner images carried thereby contacting said fuser roll, said thin web being fabricated from a material that creates lower friction between it and the copy substrate than the friction between the copy substrate and the fuser roll;

means for supporting said thin web such that said elongated surface frictionally engages said fuser roll; and biasing means urging an area of said thin web adjacent one end of said elongated surface toward said fuser roll and thereby captivating said an area of said thin web between said biasing means and said fuser roll and forming an entrance nip for receiving the lead edge of copy substrates.

17. Apparatus according to claim 16 wherein said biasing means comprises a blade member supported such that an edge of its free end contacts said thin web to thereby bias an area of said thin web into frictional contact with said fuser roll to form a nip entrance for receivng the lead edge of copy substrates.

18. Apparatus according to claim 17 wherein said edge is slightly curved.

* * * * *